US005509818A

United States Patent [19]

Lai

[11] Patent Number: 5,509,818

[45] Date of Patent: Apr. 23, 1996

[54] BNC T-TYPE ADAPTOR

[76] Inventor: Yang-Chuan Lai, No. 44, Lane 627, Sec. 5, Chung-Hsin Rd., San-Chung City, Taipei Hsien, Taiwan

[21] Appl. No.: 329,107

[22] Filed: Oct. 25, 1994

[51] Int. Cl.[6] ..... H01R 29/00

[52] U.S. Cl. ..... 439/188; 439/944

[58] Field of Search ..... 439/188, 944; 200/51.1

[56] References Cited

U.S. PATENT DOCUMENTS

| | | | |
|---|---|---|---|
| 5,030,122 | 7/1991 | Birch et al. | 439/944 X |
| 5,368,494 | 11/1994 | Lai | 439/188 OR |
| 5,387,116 | 2/1995 | Wang | 439/188 OR |

*Primary Examiner*—P. Austin Bradley
*Assistant Examiner*—Daniel Wittels
*Attorney, Agent, or Firm*—Millen, White, Zelano, & Branigan

[57] ABSTRACT

A BNC T-type adaptor includes an insulating housing which has a horizontal conducting portion with left and right parts therein, an elongated grounding unit and two insulator units sleeved around and positioning the horizontal conducting portion and the grounding unit within the insulating housing. Each of the left and right parts has a contact unit and a resilient conducting strip which is integral with an end portion of the horizontal conducting portion and which extends axially and inwardly from the contact unit. The resilient conducting strip has a distal end which normally contacts the grounding unit. Each of the insulator units cooperates with one of the left and right parts of the horizontal conducting portion and defines an annular receiving space therearound. Each of the insulator units has a circumferential wall body which defines an axial bore therethrough and which receives a corresponding one of the contact units therein. The wall body of the insulator unit has an axial slot formed therethrough which permits a slanted intermediate portion of the resilient conducting strip to protrude into the annular receiving space.

6 Claims, 8 Drawing Sheets

BNC T-TYPE ADAPTOR

BACKGROUND OF THE INVENTION

1. Field of the Invention

The invention relates to an BNC T-type adaptor, more particularly to an improved BNC T-type adaptor in which noise can be minimized and in which a good electrical connection can be provided.

2. Description of the Related Art

Referring to FIGS. 1 and 2, a first conventional BNC T-type adaptor 1 is shown to comprise a T-shaped insulating hollow housing 11 with a common branch 101 that is provided with a twist-lock member and left and right branches 102, 103 that extend from two sides of the common branch 101 and that are communicated with the same. When a cable connector 3 mates with the twist-lock member, the signals present at the common branch 101 can be received at the left and right branches 102, 103. The adaptor (1) can thus be considered as a signal distributor.

FIG. 2 illustrates an internal conductor 12 of the adaptor 1. The internal conductor 12 is made of copper and includes a vertical male conducting portion 121 that extends into the common branch 101 and a horizontal female conducting portion with left and right parts 122, 123 that extend respectively into the left and right branches 102, 103 of the insulating housing 11. The vertical male conducting portion 121 has a lowermost end which engages threadedly the horizontal female conducting portion at a screw hole 124 that is formed in an intermediate portion of the latter. Note that the left and right parts 122, 123 of the horizontal female conducting portion are shaped as tubular portions with axially extending splits 1221, 1231 for clamping an inserted male conducting plug (not shown) therein. When only one of the left or right parts 122, 123 of the horizontal female conducting portion is engaged by the inserted male conducting plug, the other one of the left and right parts 122, 123 may pick up noise, thereby resulting in signal interference.

FIGS. 3 and 4 show a second conventional BNC T-type adaptor 1*a* which includes an internal conductor with a horizontal female conducting portion 4 and a vertical male conducting portion 121*a* connected perpendicularly to the horizontal female conducting portion 4. The horizontal female conducting portion 4 has two ends, each of which is bent backward so as to form a bent resilient conducting plate 42, 43 which is adapted to clamp an inserted male conducting plug 50 (refer to FIG. 5) against the insulating housing 11*a* of the second BNC T-type adaptor la. A conducting chip 5 is disposed below the horizontal female conducting portion 4. A ceramic resistor 6 is disposed below the conducting chip 5 and connects the latter to a ground wire (not shown). When only one of the bent resilient conducting plates 42, 43 is engaged by the inserted male conducting plug 50, as shown in FIG. 5, noise and interference can be minimized because the other one of the bent resilient conducting plates 42, 43 is connected to the ground wire via the conducting chip 5 and the ceramic resistor 6.

A main drawback of this conventional BNC T-type adaptor 1*a* is that the bent resilient conducting plates 42, 43 suffer easily from elastic fatigue after a short period of use, thereby resulting in loose clamping of an inserted male conducting plug and untimely, in detachment of the inserted male conducting plug. The deeper the length of the male conducting plug which extends into one of the left and right branches of the insulating housing, the more severe the elastic fatigue will become because deep extension of the male conducting plug lifts the bent resilient conducting plates 42, 43 relative to the conducting chip 5. In case only a short length of the male conducting plug was inserted, untimely detachment eventually results. Thus, a good electrical connection cannot be achieved.

SUMMARY OF THE INVENTION

Therefore, the main objective of the present invention is to provide an improved BNC T-type adaptor in which noise and signal interference can be minimized.

Another objective of the present invention is to provide an improved BNC T-type adaptor which can provide good contact between an inserted conducting plug so as to achieve a good electrical connection.

Accordingly, the BNC T-type adaptor of this invention includes a T-shaped insulating hollow housing which has a vertical common branch, and left and right branches that extend horizontally from two sides of the common branch and that are communicated with the common branch. Each of the left and right branches is adapted to receive a conducting plug with a tubular insulator. An internal conductor is disposed in the insulating housing and includes a vertical conducting portion which extends into the common branch and a horizontal conducting portion that is connected to the vertical conducting portion and that has left and right parts that extend into the left and right branches of the insulating housing respectively. An elongated grounding unit is disposed below the horizontal conducting portion in the insulating housing. Two insulator units are sleeved around and position the left and right parts of the horizontal conducting portion and the elongated ground unit within the insulating housing. Each of the left and right parts of the horizontal conducting portion has a contact unit disposed thereon and a resilient conducting strip which is integral with an end portion of the horizontal conducting portion and which has a slanted intermediate portion. The resilient conducting strip extends axially and inwardly from the contact unit. The contact units are adapted to connect electrically with the conducting plugs respectively. Each of the resilient conducting strips further has a distal end which is located below the contact unit and which normally contacts the grounding unit. Each of the insulator units has a circumferential wall body which defines an axial bore therethrough and which receives a corresponding one of the contact units therein. Each of the insulator units is associated with a corresponding one of the left and right branches of the insulating housing and with the internal conductor to constitute a socket unit in which one of the contact units is disposed. Each of the socket units is associated with a corresponding one of the conducting plugs to constitute a plug-and-socket assembly. In each of the-plug-and-socket assemblies, the wall body of the insulator unit cooperates with one of the left and right branches of the insulating housing so as to define an annular receiving space around the insulator unit for receiving the tubular insulator of the conducting plug therein. In each of the plug-and-socket assemblies, the wall body of the insulator unit further has an axial slot formed therethrough through which the slanted intermediate portion of the resilient conducting strip extends so as to protrude into the annular receiving space. Thus, when the conducting plug is inserted into one of the left and right branches so as to contact the contact unit, the tubular insulator enters into the annular receiving space to push the slanted intermediate portion of the resilient conducting strip radially and inwardly of the wall body of the insulator unit so as to disengage the resilient conducting strip from the grounding unit.

In each of the plug-and-socket assemblies, the insulator unit preferably has a positioning device for positioning the tubular insulator of the conducting plug within the socket unit when the conducting plug is inserted into the socket unit. The positioning devices may be shoulders formed between two different sections of the insulator units. Thus, in each of the plug and socket assemblies, when the conducting plug is inserted into the socket unit, the tubular insulator is stopped by the shoulder from entering further into the socket unit, thereby positioning the tubular insulator in the annular receiving space.

In one embodiment, each of the contact units is a tubular member, and the horizontal conducting portion preferably includes an elongated plate which is formed integrally with the tubular members. Each of the tubular members has a plurality of open-ended axial splits formed through a wall thereof.

In another embodiment, the elongated plate member has an intermediate portion with a protrusion projecting upwardly therefrom. The protrusion has two opposed reinforcing wall portions.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENT

Figure 1:
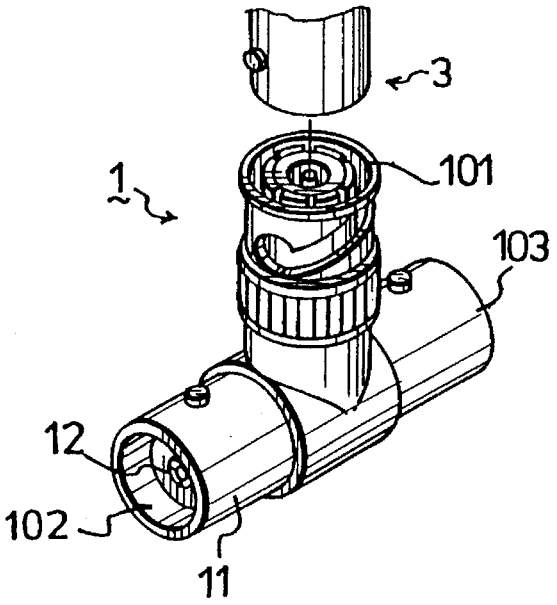
FIG.1 (PRIOR ART)
FIG. 1 is a perspective view of a first conventional BNC T-type adaptor.
Figure 2:
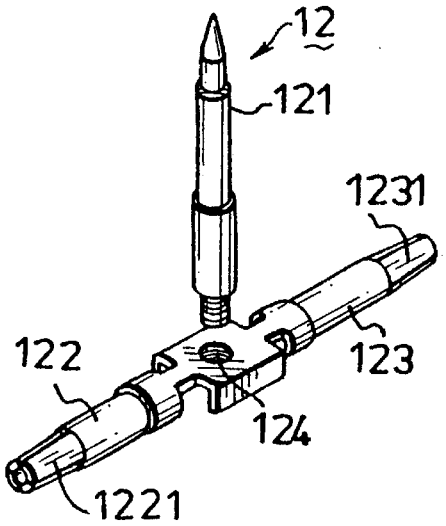
FIG.2 (PRIOR ART)
FIG. 2 is an exploded view of an internal conductor of the first conventional adaptor shown in FIG. 1.
Figure 3:
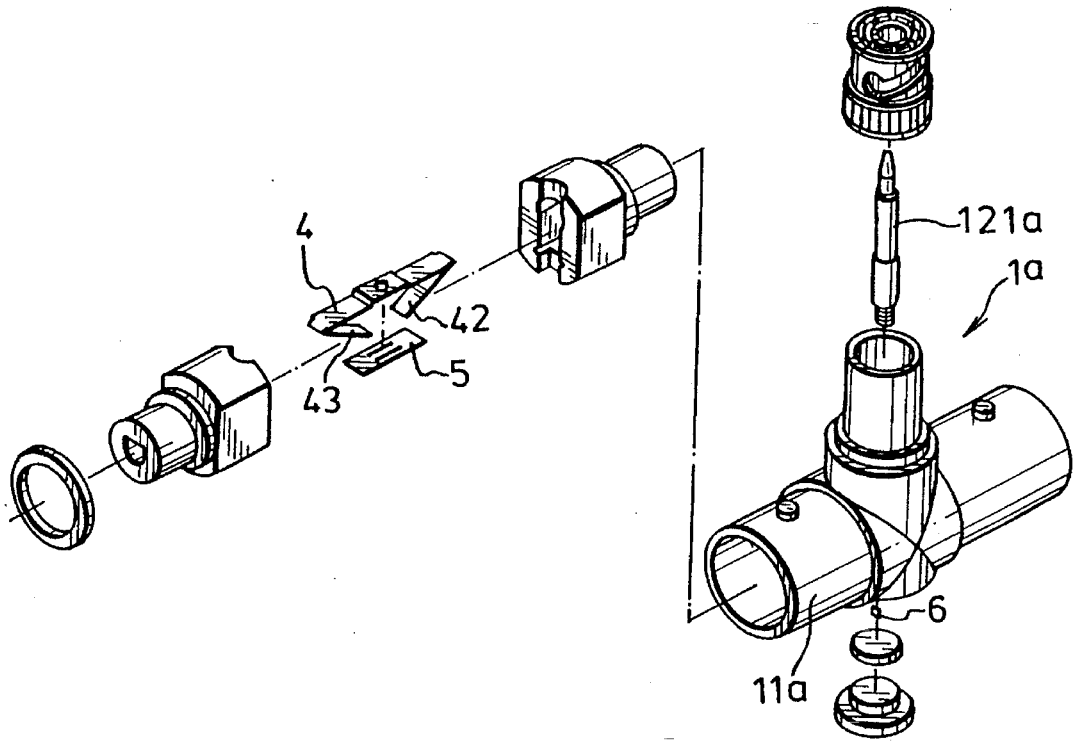
FIG.3 (PRIOR ART)
FIG. 3 shows an exploded view of a second conventional BNC T-type adaptor.
Figure 4:
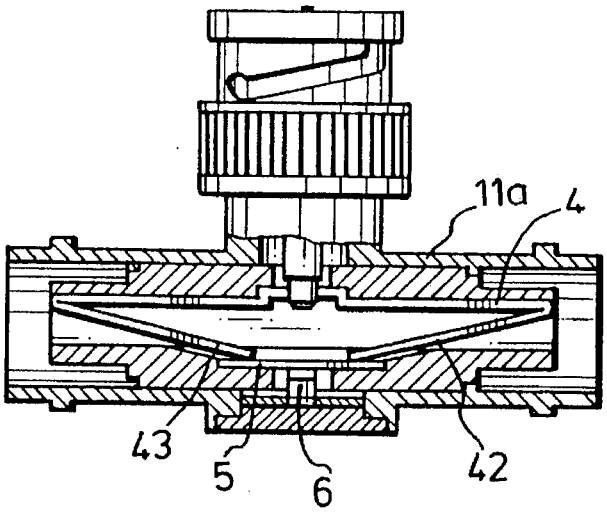
FIG.4 (PRIOR ART)
FIG. 4 illustrates the internal structure of the left and right branches of the second conventional BNC T-type adaptor.
Figure 5:
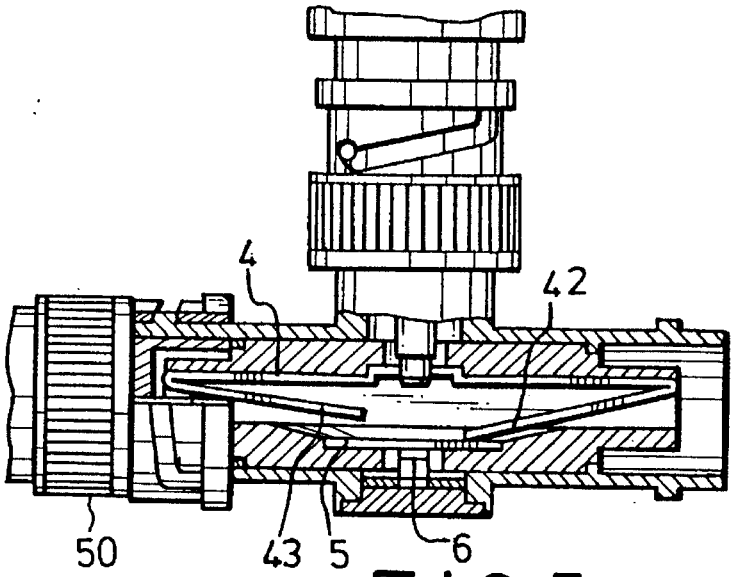
FIG.5 (PRIOR ART)
FIG. 5 illustrates how the second conventional BNC T-type adaptor receives an inserted conducting plug at one end thereof.
Figure 6:
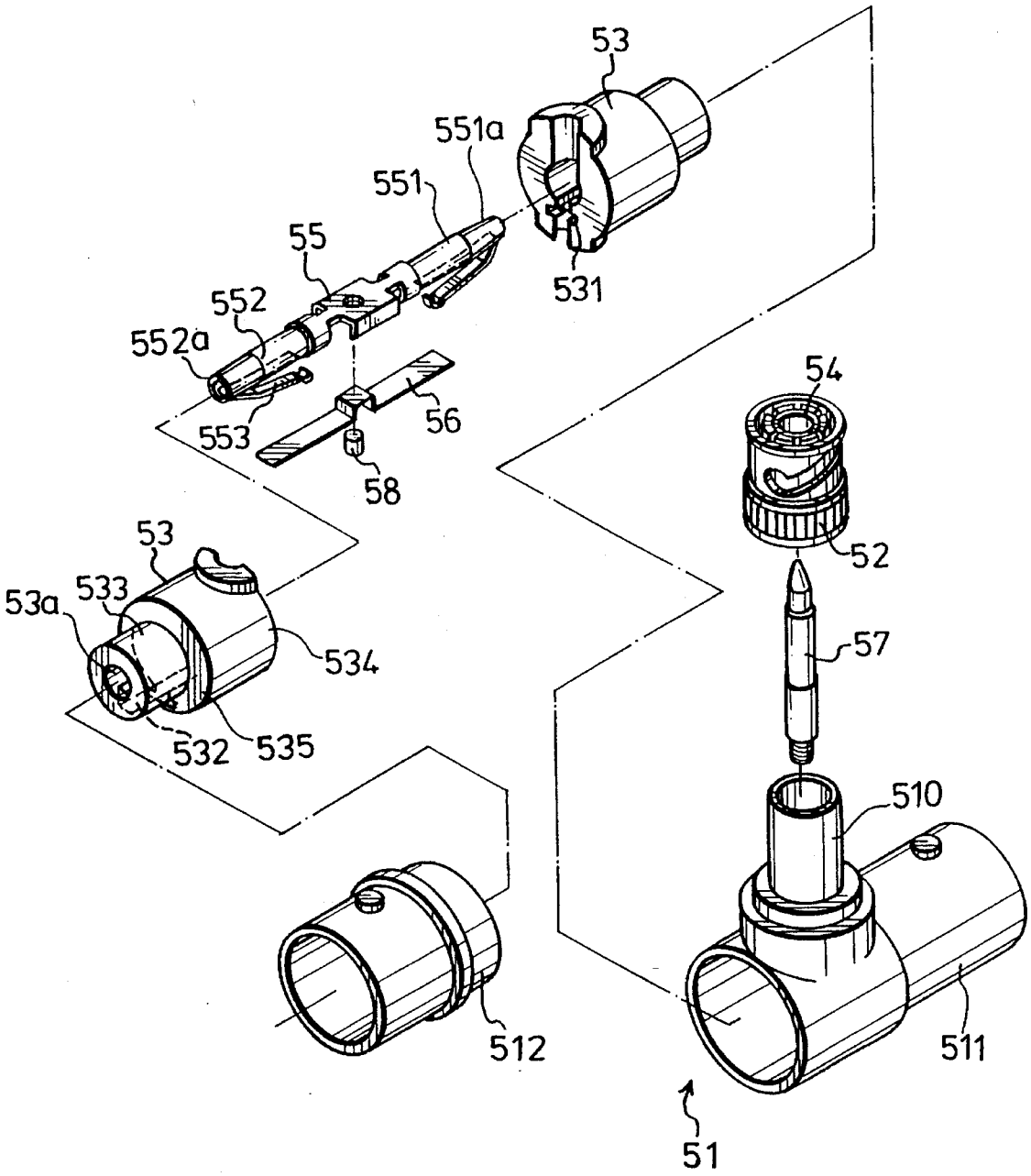
FIG. 6 shows an exploded view of a BNC T-type adaptor according to the present invention.
Figure 7:
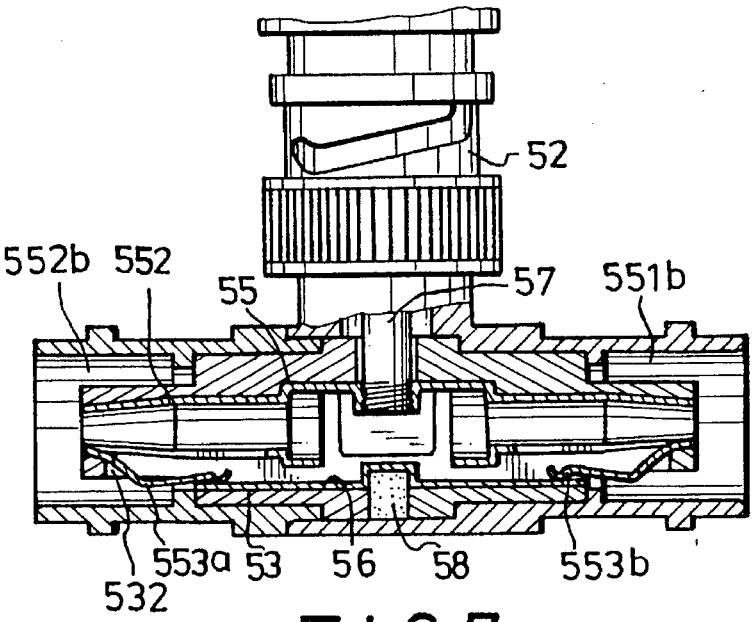
FIG. 7 illustrates the internal structure of the left and right branches of the adaptor shown in FIG. 6.

Referring to FIGS. 6 and 7, a BNC T-type adaptor of the present invention is shown to comprise a T-shaped insulating hollow housing with an internal conductor, a pair of insulator units 53, a conducting chip 56 and a resistor 58. The insulating housing has a vertical common branch 510 over which a twist-lock member 54 is mounted so as to receive a plug unit 6, and left and right branches 511, 512 that extend horizontally from two sides of the common branch 510 and that are communicated with the common branch 510. Note that each of the left and right branches 511, 512 of the insulating housing is adapted to receive a plug unit with an inner conducting plug and a tubular insulator around the inner conducting plug.

The internal conductor is disposed in the insulating housing and includes a vertical conducting portion 57 which extends into the common branch 510 and a horizontal conducting portion 55 that is connected to the vertical conducting portion 57 and that has left and right parts 551, 552 which extend respectively into the left and right branches 511, 512 of the insulating housing.

The conducting chip 56 and the resistor 58 are disposed below the horizontal conducting portion 55 in the insulating housing and cooperatively serve as a grounding unit. In the preferred embodiment, each of the left and right parts 551, 552 of the horizontal conducting portion 55 has a contact unit 551*a*, 552*a*, in the form of a tubular member, and a resilient conducting strip 553 which is integral with an end portion of the horizontal conducting portion 55 and which extends axially and inwardly from the contact unit 551*a*, 552*a*. Note that the contact units 551*a*, 552*a* are adapted to connect electrically with the inner conducting plug. Each of the resilient conducting strips 553 has a slanted intermediate portion 553*a* (see FIG. 7) and a distal end 553*b* which normally contacts the conducting chip 56.

The insulator units 53 are sleeved around the left and right parts 551, 552 of the horizontal conducting portion 55, the conducting chip 56 and correspondingly position the former two within the insulating housing. Each of the insulator units 53 has a circumferential wall body which defines an axial bore 53*a* therethrough and which receives a corresponding one of the contact units 551*a*, 552*a* therein. Each of the insulator units 53 has a small-diameter outer section 533 and a large-diameter inner section 534 which has an outer diameter larger than that of the small-diameter section 533. Thus, the small-diameter outer section 533 and the large-diameter inner section 534 together define a shoulder 535 therebetween. The small-diameter outer section 533 of the wall body of each of the insulator units 53 cooperates with one of the left and right branches 511, 512 of the insulating housing so as to define an annular receiving space 551*b*, 552*b* around the insulator unit 53. The wall body of the insulator unit 53 further has an axial slot 532 of a predetermined length formed therethrough and aligned with the resilient conducting strip 553 such that the slanted intermediate portion 553*a* of the resilient conducting strip 553 protrudes into the annular receiving space 551*b*, 552*b*.

Note that each of the insulator units 53 is associated with a corresponding one of the left and right branches 511, 512 of the insulating housing and with the horizontal conducting portion 55 of the internal conductor to constitute a socket unit in which one of the contact units 551*a*, 552*a* is disposed.

Figure 8:
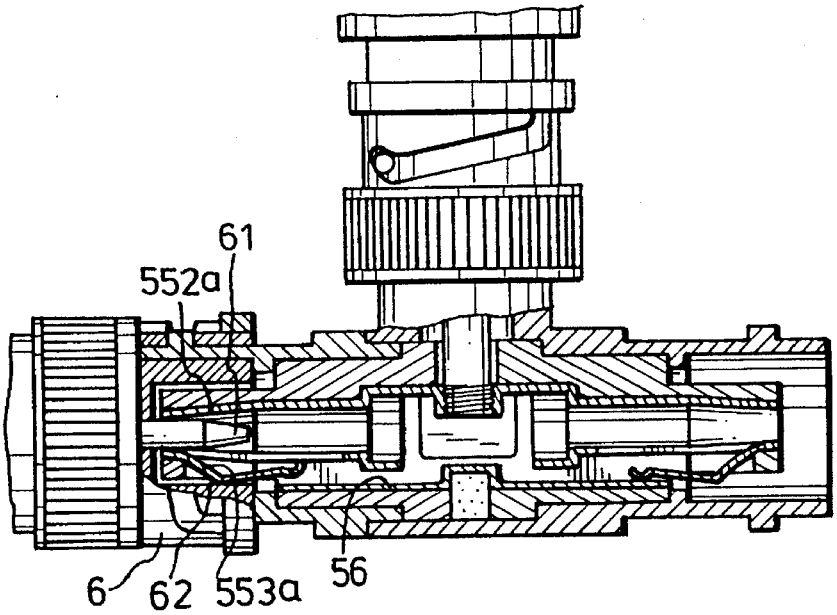
FIG. 8 illustrates how the adaptor of the present invention receives an inserted conducting plug with a tubular insulator therearound.
Figure 9:
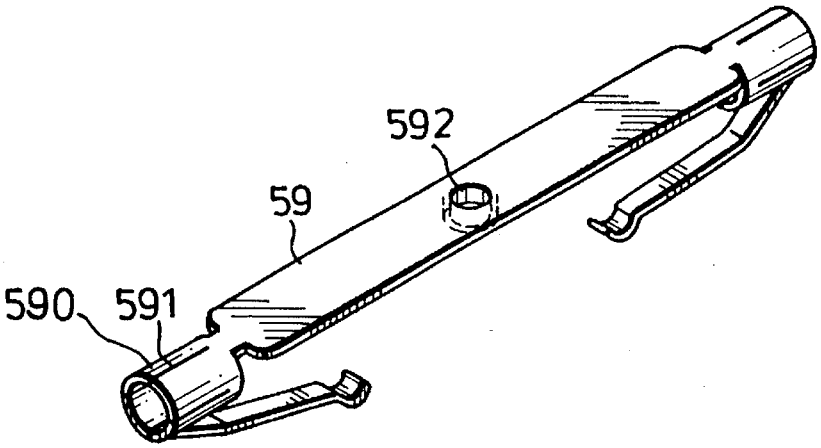
FIG. 9 is a perspective view showing an alternative form of a horizontal female conducting portion of an internal conductor that is disposed within the adaptor of the present invention.
Figure 10:
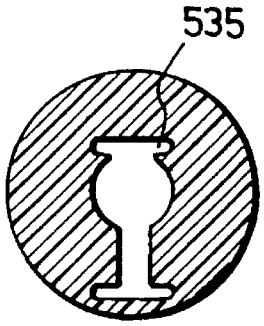
FIG. 10 shows a cross-sectional view of an insulator unit employed in the adaptor of the present invention.
Figure 11:
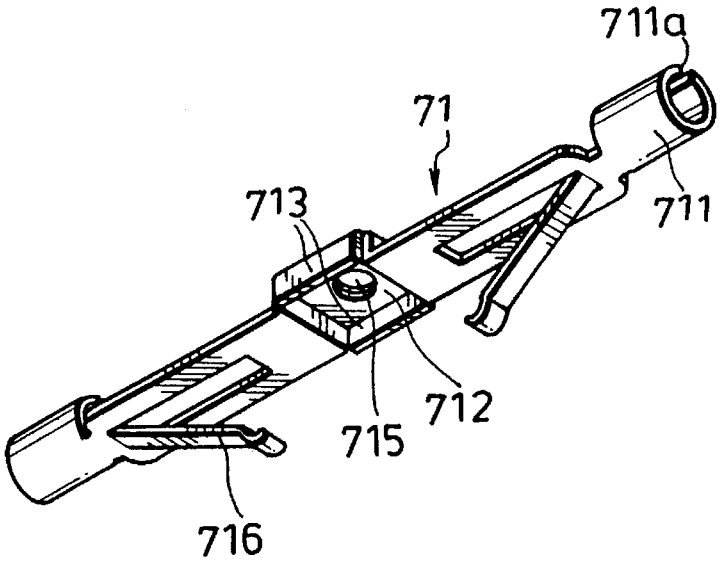
FIG. 11 shows a perspective view showing another alternative form of a horizontal female conducting portion of an internal conductor that is disposed within the adaptor of the present invention.
Figure 12:
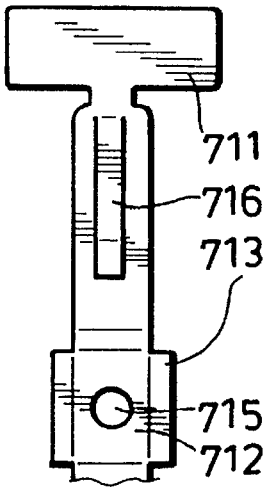
FIG. 12 is an elevational view of a portion of the horizontal female conducting portion shown in FIG. 11.
Figure 13:
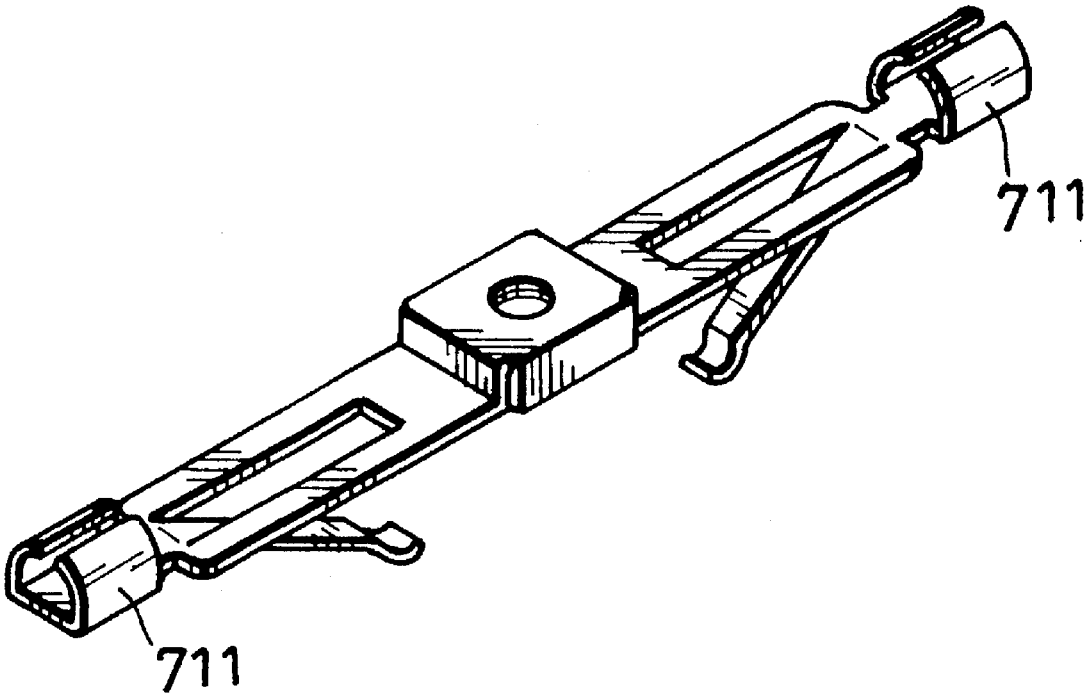
FIG. 13 shows a perspective view of still another form of a horizontal female conducting portion of an internal conductor that is disposed within the adaptor of the present invention.

Referring to FIG. 8, when the plug unit 6 is inserted into the left branch 512, the inner conducting plug 61 of the plug unit 6 contacts the contact unit 552*a*, while the tubular insulator 62 of the plug unit 6 enters into the annular receiving space 552*b* to push the slanted intermediate portion 553*a* of the resilient conducting strip 553 radially and inwardly of the wall body of the insulator unit 53 so as to disengage the resilient conducting strip 553 from the conducting chip 56. The tubular insulator 62 of the plug unit 6 is stopped by the shoulder 535 from entering further into the socket unit, thereby positioning the tubular insulator 62 in the annular receiving space 552*b*. The shoulder 535 thus serves as a positioning device for the inserted plug unit. Note that under such a condition, since the other one of the resilient conducting strips 553 is connected to the grounding unit via the conducting strip 56 and the ceramic resistor 58, noise and signal interference can be minimized.Referring to FIG. 9, the contact units of a horizontal conducting portion 59 employed in another preferred embodiment of the present invention are tubular members 590 with open-ended axial splits 591 such that the tubular members 590 can receive the inserted conducting plug 61 of the plug unit 6 clampingly, thereby providing a good electrical connection. In order to complement the configuration of the horizontal conducting portion 59, the insulator unit 53 has an axial groove 535 (see FIG. 10) to receive the tubular member 590.Referring to FIG. 12, in still another preferred embodiment, the horizontal conducting portion is an elongated plate 71 that possesses two enlarged end portions 711 and a rectangular intermediate portion 712 with a hole 715 formed therethrough. Each of the enlarged end portions 711 is rolled to form an axial slot 711*a* so as to serve as a contact unit. The intermediate portion 712 is pressed so as to form a protrusion with reinforcing wall portions 713, while the portion of the elongated plate 71 between the enlarged end portions 711 and the intermediate portions 712 are pressed axially. Thus, two resilient conducting strips 716 are obtained which extend axially and inwardly from the tubular members 711, as shown in FIGS. 11 and 13.When the plug unit 6 is inserted into the socket unit of the adaptor of this invention, inward and radial extraction of the slanted intermediate portion of the resilient conducting strip into the insulator unit is stopped by the inserted conducting plug so that the resilient conducting strip does not easily suffer from fatigue.Another aspect to note is that the length of the conducting plug 61 of the plug unit 6 does not need to be precisely measured so that the manufacturing cost is reduced.With the present invention thus explained, it is obvious to those skilled in the art that various modifications and variations can be made without departing from the scope and spirit of this invention. It is therefore intended that this invention be limited only as in the appended claims.

I claim:1. A BNC T-type adaptor including a T-shaped insulating hollow housing having a vertical common branch, and left and right branches that extend horizontally from two sides of said common branch and that are communicated with said common branch, each of said left and right branches being adapted to receive a conducting plug with a tubular insulator;

an internal conductor disposed in said insulating housing and including a vertical conducting portion which extends into said common branch and a horizontal conducting portion that is connected to said vertical conducting portion and that has left and right parts that extend into said left and right branches respectively;

an elongated grounding unit disposed below said horizontal conducting portion in said insulating housing; and two insulator units being sleeved around and positioning said left and right parts of said horizontal conducting portion and said elongated ground unit within said insulating housing;

wherein the improvement comprises:

each of said left and right parts of said horizontal conducting portion having a contact unit disposed thereon and a resilient conducting strip which is integral with an end portion of said horizontal conducting portion and which extends axially and inwardly from said contact unit, said contact units being adapted to connect electrically with said conducting plugs respectively, each of said resilient conducting strips having a slanted intermediate portion and a distal end which is located below said contact unit and which normally contacts said grounding unit; and each of said insulator units having a circumferential wall body which defines an axial bore therethrough and which receives a corresponding one of said contact units therein, each of said insulator units being associated with a corresponding one of said left and right branches of said insulating housing and with said internal conductor to constitute a socket unit in which one of said contact units is disposed, each of said socket units being associated with a corresponding one of said conducting plugs to constitute a plug-and-socket assembly;

in each of said plug-and-socket assemblies, said wall body of said insulator unit cooperating with one of said left and right branches of said insulating housing so as to define an annular receiving space around said insulator unit for receiving said tubular insulator of said conducting plug therein;

in each of said plug-and-socket assemblies, said wall body of said insulator unit further having an axial slot formed therethrough through which said slanted intermediate portion of said resilient conducting strip extends to protrude into said annular receiving space;

whereby, in each of said plug-and-socket assemblies, when said conducting plug is inserted into one of said left and right branches so as to contact said contact unit, said tubular insulator enters into said annular receiving space to push said slanted intermediate portion of said resilient conducting strip radially and inwardly of said wall body of said insulator unit so as to disengage said resilient conducting strip from said grounding unit.2. The BNC T-type adaptor as defined in claim 1, wherein, in each of said plug-and-socket assemblies, said insulator unit has a positioning device for positioning said tubular insulator of said conducting plug within said socket unit when said conducting plug is inserted into said socket unit.3. The BNC T-type adaptor as defined in claim 2, wherein, in each of said plug-and-socket assemblies, said insulator unit has a small-diameter outer section and a large-diameter inner section which has an outer diameter larger than that of said small-diameter section, said small-diameter outer section and said large-diameter inner section together defining therebetween a shoulder constituting said positioning device, whereby when said conducting plug is inserted into said socket unit to contact said tubular insulator with said shoulder, said resilient conducting strip is removed from said grounding unit.4. The BNC T-type adaptor as defined in claim 1, wherein each of said contact units is a tubular member, and said horizontal conducting portion including an elongated plate formed integrally with said tubular members.5. The BNC T-shaped adaptor as defined in claim 4, wherein each of said tubular members has a plurality of open-ended axial splits formed through a wall thereof.6. The BNC T-shaped adaptor as defined in claim 4, wherein said elongated plate member has an intermediate portion with a protrusion projecting upwardly therefrom, said protrusion having two opposed reinforcing wall portions.

* * * * *